US006910931B1

(12) United States Patent
Nakase

(10) Patent No.: US 6,910,931 B1
(45) Date of Patent: Jun. 28, 2005

(54) LIFE SAVING DEVICE PROVIDED WITH BODY TEMPERATURE ADJUSTER

(75) Inventor: Kazuo Nakase, Tokyo (JP)

(73) Assignees: Kimihiko Ezawa, Tokyo (JP); Yoshio Aikawa, Kanagawa (JP)

( * ) Notice: Subject to any disclaimer, the term of this patent is extended or adjusted under 35 U.S.C. 154(b) by 0 days.

(21) Appl. No.: 10/845,554

(22) Filed: May 12, 2004

(30) Foreign Application Priority Data

Jan. 16, 2004 (JP) ..... 2004-009490

(51) Int. Cl.[7] ..... B63C 9/08
(52) U.S. Cl. ..... 441/106; 2/458; 405/186; 126/204
(58) Field of Search ..... 405/186; 126/204; 2/458

(56) References Cited

U.S. PATENT DOCUMENTS

| | | | | |
|---|---|---|---|---|
| 2,429,973 A | * | 11/1947 | Alexander | 126/204 |
| 3,367,319 A | * | 2/1968 | Carter, Jr. | 126/204 |
| 3,519,021 A | * | 7/1970 | Wiswell, Jr. | 137/625.47 |
| 3,778,590 A | * | 12/1973 | Iizuka et al. | 219/211 |
| 3,815,573 A | * | 6/1974 | Marcus | 126/204 |
| 5,603,648 A | * | 2/1997 | Kea | 441/106 |
| 6,098,612 A | * | 8/2000 | Nakamoto et al. | 126/204 |

FOREIGN PATENT DOCUMENTS

| | | |
|---|---|---|
| JP | 4-77915 | 7/1992 |
| JP | 7-246215 | 9/1995 |
| JP | 9-187473 | 7/1997 |
| JP | 2696744 | 9/1997 |
| JP | 2000-60891 | 2/2000 |
| JP | 2000-90377 | 3/2000 |
| JP | 2002-119530 | 4/2002 |
| JP | 2002-127986 | 5/2002 |
| JP | 3088258 | 6/2002 |
| JP | 2002-362482 | 12/2002 |
| JP | 3094467 | 3/2003 |

* cited by examiner

*Primary Examiner*—Jesus D. Sotelo
(74) *Attorney, Agent, or Firm*—Ladas & Parry LLP

(57) ABSTRACT

The invention provides a life-saving device including means for allowing the wearer to be found easily, and a body temperature adjuster for maintaining the body temperature of the wearer at a proper body temperature by fine-adjusting the body temperature of the wearer depending on the outside temperature or the body temperature until the wearer is rescued. The life-saving device includes heating members disposed so as to contact both sides of the neck where common carotid arteries run through and both armpits where axillary arteries run through when the main body of the life-saving device is worn, a power source for supplying electricity to the heating members, a body temperature detecting means for detecting the body temperature, an outside temperature detecting means for detecting the outside temperature, and a temperature controller for adjusting the temperature of the heating members in response to the temperature detected by the body temperature detecting means and the outside temperature detecting means, so that the body temperature of the wearer can be maintained at a proper temperature in case of emergency.

23 Claims, 7 Drawing Sheets

LIFE SAVING DEVICE PROVIDED WITH BODY TEMPERATURE ADJUSTER

BACKGROUND OF THE INVENTION

1. Field of the Invention

The present invention relates to a life-saving device and, more specifically to improvement of life-saving function in a life-saving device provided with a body temperature adjuster which can adjust the temperature of the wearer.

2. Description of the Related Art

A lifesaving device (life jacket) well known in the related art is configured to ensure floating feature assuming that it is mainly used in scenes of distress. In addition, such a life-saving device is configured to be easy to wear in case of emergency and to be capable of offering buoyancy in a moment of time.

As a life-saving device as described above, for example, a vest-type inflating life-saving device is disclosed in JP-A-2002-362482. A neck-hanging style inflating life-saving device which is put around the neck is disclosed in JP-A-2002-127986. However, although such life-saving devices are configured to be inflated automatically or manually to offer buoyancy when the wearer gets into water, they are not provided with means for heating the wearer's body so as to prevent heat loss from the body when he/she is in distress in the sea area of low temperature. Therefore, in case of distress in the sea area of low temperature, there is a risk that the wearer dies before rescue corps such as a rescue boat or a rescue aircraft arrive even when such a life-saving device is putted on.

Generally, what affects the survival time of the victim in water is heat loss from the body. The temperature of human beings is automatically adjusted to keep the body temperature at 37° C. constantly. When the body temperature is decreased to 35° C. or below, he/she gets trapped into a low-temperature symptom appears, and he/she suffers from severe shakes and agony, resulting in reduction of sensitivity of nerves and confusion of consciousness. When the body temperature is further lowered below 31° C., shaking stops, but his/her muscles become stiff instead, and pulsation of heart is weakened, resulting in irregular heart pulsation. In this stage, the victim may drop into unconsciousness. It is said that when one's body temperature is decreased to 30° C. or below, one can hardly recognize whether he/she is alive or dead.

As a life-saving device corresponding to such circumstances, a life jacket provided with a radio beacon for detecting the position of distress using a GPS receiver and transmitting a position signal via a radio transmitter so as to allow rescuers arrive the site rapidly is disclosed in JP-A-2000-90377.

In addition, for example, Japanese Patent No.2696744 discloses a life jacket having a positive heating capability for extending survival time of an aircraft passenger until he/she is rescued by the rescue boat or by the rescue aircraft in the case where the aircraft has landed on the sea area of low temperature when an emergency arises.

FIG. 1 is an explanatory drawing showing the front surface of a cold-and-water-proof vest disclosed in Japanese Patent No.2696744. In this drawing, the cold-and-water-proof vest 101 includes a flat plate shaped chemical heat generating agent 102 which generates heat by oxidizing reaction in the atmosphere, a heat generating body storing bag 104 having a pocket 103 for dismountably retaining the chemical heat generating agent 102 therein and being formed of hermetical material having an closable opening, an air feed valve 106 mounted to the heat generating body storing bag 104 and capable of feeding oxygen from a compact pure oxygen tank 105 through a depressurizing regulator into the heat generating body storing bag 104, and an exhaust valve 107 mounted to the heat generating body storing bag 104 and capable of discharging air in the heat generating body storing bag 104, and is configured to feed oxygen upon operation of the air feed valve 106 to activate a heat generating action of the chemical heat generating agent 102, and to feed oxygen discontinuously by the air feed valve 106 and, if necessary, to discharge air by the operation of the air feed valve 106 and the exhaust valve 107, so that the body temperature is maintained.

However, in the life-saving device body according to JP-A-2000-90377, since the time period required for rescuers to effect a rescue is unknown, the victim has a risk to die due to heat loss from his/her body before the rescuers arrive in case of a distress in the sea area of low temperature.

In the cold-and-water-proof vest 101 disclosed in Japanese Patent No.2696744, since heating sites heated by the chemical heat generating agent 102 are mainly the wearer's chest, belly, and back, effective adjustment of body temperature cannot be achieved. Medically, heat of the body is transferred by heat conduction in the ecological tissue and circulating blood flow. The rate of heat conduction of the ecological tissue is 0.001 cal/(s·cm$^2$·° C.) for muscle and 0.0005 cal/(s·cm$^2$·° C.) for fat without blood flow. In contrast, the rate of heat conduction in the case where a heat quantity is transferred by blood flowing through blood vessels (100 $\mu$m in diameter), which is thicker than blood capillary (about 10 $\mu$m in diameter), at a flow rate of 1 ml/s is about 0.24 cal/(s·cm$^2$·° C.). Therefore, in order to adjust the body temperature, it is effective to heat or cool portions of the body where thick arteries run through in the vicinity of the surface of the body. Such portions of the body include both sides of the neck where common carotid arteries run through, both armpits where axillary arteries run through, the central portion of the back of the body where aorta runs through, and both groins where external iliac arteries run through. Therefore, the cold-and-water-proof vest 101 which does not cool these portions of the body cannot control the body temperature effectively.

In addition, in the cold-and-water-proof vest 101, since the pure oxygen tank 105 which contains oxygen to be supplied to the chemical heat generating agent 102 needs to have an increased capacity for long term application, it is difficult to reduce the weight and the size.

Since the chemical heat generating agent 102 stops its heat generating action when the oxidizing action stops, the operating time is limited. Furthermore, since it is difficult to go on with fine adjustment of the temperature, concern remains about whether it is suitable as a device for supporting life. Furthermore, the chemical heat generating agent 102 generates heat upon reaction with oxygen, it is necessary to avoid contact with oxygen in the air other than when it is in use. Therefore, the chemical heat generating agent 102 is difficult to manage, and has a risk to generate heat when it is not necessary.

The cold-and-water-proof vest 101 has a heating effect, but has no cooling effect. Suppose the site of distress is the sea right on the equator, the sensible temperature may exceed 40° C. Under such situation, the body temperature may exceed a proper temperature, which may cause heat attack. Therefore, a life-saving device provided not only with a heating effect, but also with a cooling effect has been desired by people involved in aircraft or marine affairs.

Furthermore, since the cold-and-water-proof vest 101 does not have means for signaling the position of the wearer, it is difficult for rescuers to find the victim. Actually, even when the victim is wearing the life-saving device, it is difficult to get out of trouble by his/her own ability, and thus the victim cannot guard his/her own life unless he/she is rescued by the rescuers performing rescue activities. Therefore, since the cold-and-water-proof vest 101 is not configured to allow the rescuers to arrive at the site of distress as soon as possible and find quickly the victim, the victim has a risk to loose the bodily strength and hence die before being rescued.

Not only in the aforementioned marine life-saving device, but also in cloths which is designed to wear in the area where the difference between the proper body temperature and the outside temperature is significant, such cold districts or high-temperature districts, for example, warm cloths for mountains, fireman's cloths, or bullet-proof vests to be worn in battlefields such as desert regions, a cloth having a function to heat or cool the wearer's body according to the outside temperature or the body temperature has been desired.

SUMMARY OF THE INVENTION

In view of such circumstances, it is an object of the present invention to provide a life-saving device including means for providing easy identification of the wearer and a body temperature adjuster that can fine adjust the temperature of the wearer depending on the outside temperature or the body temperature for maintaining the body temperature at a proper body temperature until the wearer is rescued.

The above-described object of the present invention is achieved by providing heating members disposed so as to contact both sides of the neck where the common carotid arteries run through and the both armpits where axillary artery run through when the life-saving device body is put on the body, a power source for supplying electricity to the heating members, a body temperature detecting means for detecting the body temperature, an outside temperature detecting means for detecting the outside temperature, and a power source for supplying an electric current to the heating members, a temperature controller for adjusting the temperature of the heating members in response to the temperatures detected by the body temperature detecting means and the outside temperature detecting means, so that the body temperature is maintained at a proper temperature in case of emergency.

The above-described object is effectively achieved by disposing the heating member so as to pass in the vicinity of the heart when the wearer wears the life-saving device body.

The above-described object is effectively achieved by disposing the heating member so as to contact the central portion of the back of the body where the aorta runs through when the wearer wears the life-saving device body.

The above-described object is achieved by disposing the heating members so as to contact the groins where external iliac arteries run through when the wearer wears the life-saving device body.

The above-described object is effectively achieved by that the life-saving device body is a marine-disaster-specific life jacket having a buoyant property and a water-proof property.

The above-described object is effectively achieved by that the life-saving device body is a marine-disaster-specific neck-hanging style life vest having a buoyant property and a water-proof property.

The above-described object is effectively achieved by that the life-saving device body is a marine-disaster-specific tubular life-saving device having a buoyant property and a water-proof property.

The above-described object is effectively achieved by that the life-saving device body is a marine-disaster-specific all-in-one life-saving suit having a buoyant property and a water-proof property.

The above-described object is effectively achieved by that the life-saving device body is a bullet-proof vest having a bullet-proof property.

The above-described object is effectively achieved by that the life-saving device body is afire-resistant cloth having a fire-resistant property.

The above-described object is effectively achieved by that the life-saving device body is a heavy winter cloth having a cold-resistant property.

The above-described object is effectively achieved by that the temperature controller includes ROM in which the standard body temperature is stored, and CPU for comparing the standard body temperature and the body temperature detected by the body temperature detecting means and adjusting the temperature of the heating member.

The above-described object is effectively achieved by that the temperature controller includes a body temperature setting button for setting the standard body temperature as desired, and a display unit for displaying the standard body temperature.

The above-described object is effectively achieved by that the heating member includes one or more Peltier elements of which an electric current supplied from the power source is controlled by the temperature controller, and a heat conductor for conducting heat from the Peltier elements to the body.

The above-described object is effectively achieved by that the life-saving device body includes a transceiver having a receiving means for receiving current position information from a GPS satellite and a transmitting means for transmitting the current position information received by the receiving means to a rescue system device.

The above-described object is effectively achieved by that the transceiver includes a communication unit for communicating with another transceiver, and the transceiver and another transceiver have a main-sub relationship.

The above-described object is effectively achieved by that the power source includes a solar battery and a storage battery storing an electric power generated by the solar battery.

The above-described object is effectively achieved by that the power source includes an auxiliary battery.

The above-described object is effectively achieved by that a part or the entire surface of the life-saving device body is colored into a fluorescent color.

The above-described object is effectively achieved by that the life-saving device body includes a light-emitting device on the surface thereof, and the light-emitting device is designed to turn a light on or to blink using the electric power supplied from the power source.

According to the life-saving device provided with the body temperature adjuster according to the present invention, the heating members disposed so as to contact the both sides of the neck where common carotid arteries run through when the life-saving device body is put on the body, the both armpits where axillary arteries run through, the both groins where external iliac arteries run through and in the vicinity of the heart, the central portions of the back of the body where aorta runs through, the power source for supplying electricity to the heating members, the body temperature detecting means for detecting the body temperature, the outside temperature detecting means for detecting the outside temperature, and the temperature controller for adjusting the temperature of the heating members in response to the temperatures detected by the body temperature detecting means and the outside temperature detecting means. Accordingly, the portions where circulating blood flow (thick vessel) having significant body temperature adjusting capability passes through can be simultaneously cooled or heated. Accordingly, since effective adjustment of the body temperature is achieved when wearing the present life-saving device, the body temperature can be maintained at a proper body temperature in case of emergency, such as a distress in the sea area of low temperature, a distress in cold districts, or a distress in the high-temperature districts, so that shortening of the survival time due to heat loss from the body can be prevented.

The heating member includes the Peltier elements and the heat conductor for conducting heat of the Peltier element to the body, and the temperature controller includes ROM in which the standard body temperature is stored and CPU for comparing the detection value of the body temperature detecting means and the standard body temperature and adjusting the temperature of the heating members. Accordingly, fine adjustment of heating and cooling of the body temperature adjuster can be performed utilizing the characteristics of Peltier effect that heat moves in the direction of current flow and hence heat absorbing portion and heat generating portion are formed. As a consequence, the body temperature of the wearer can easily be fine-adjusted.

The temperature controller is provided with the body temperature setting button for setting the standard body temperature as desired and the display unit for displaying the standard body temperature. Accordingly, the wearer can set the standard body temperature as desired in such a manner that he/she sets the standard body temperature at a lower temperature when he/she feels hot, and at a higher temperature when he/she feels cold.

The life-saving device body is provided with the receiving means for receiving the current position information from the GPS satellite and the transmitting means for transmitting the current position information received by the receiving means, and the surface of the life-saving device body is colored in a fluorescent color and is provided with the light-emitting device which turns on the light or flickers the light by the power source. Accordingly, the position of the wearer can be acknowledged by the rescuers and then the rescuers can easily find the victim when arrived at the rescue site.

By employing the solar battery as the power source, it can be semi-permanently operated in fact during a day time with sun shine. By providing the storage battery which stores electricity generated by the solar battery and the auxiliary battery to be used when an electric power in the solar battery and the storage battery is running short, the power supply can be obtained even during the night.

In addition, the present life-saving device can be applied to marine-disaster specific life-saving devices of different shapes, such as the neck-hanging style life vest, the all-in-one life-saving suit, or a tubular life-saving device. Furthermore, it can be applied to cloths to be worn in the site where the difference between a proper body temperature and the outside temperature is significant, such as the bullet-proof vest, the fire-resistant cloth, or the heavy winter cloth. Accordingly, even in the field in which these cloths, which have been suffering from a problem of decrease in percentage of survival due to loss of heat from the body or increase in body temperature, the body temperature can be maintained at the proper body temperature, and hence increase in percentage of survival can be achieved.

In other words, by wearing the life-saving device provided with the body temperature adjuster according to the present invention in case of distress, even when the site of distress is the sea area of low temperature, the wearer can maintain his/her body temperature at a proper body temperature, and can notice his/her current position to the rescuers. As a consequence, in case of distress, if the victim is wearing the present life-saving device, the victim can be rescued even in such distress accident that the possibility of survival of the victim has been low with the life-saving device in the related art.

DESCRIPTION OF THE PREFERRED EMBODIMENTS

Figure 1:
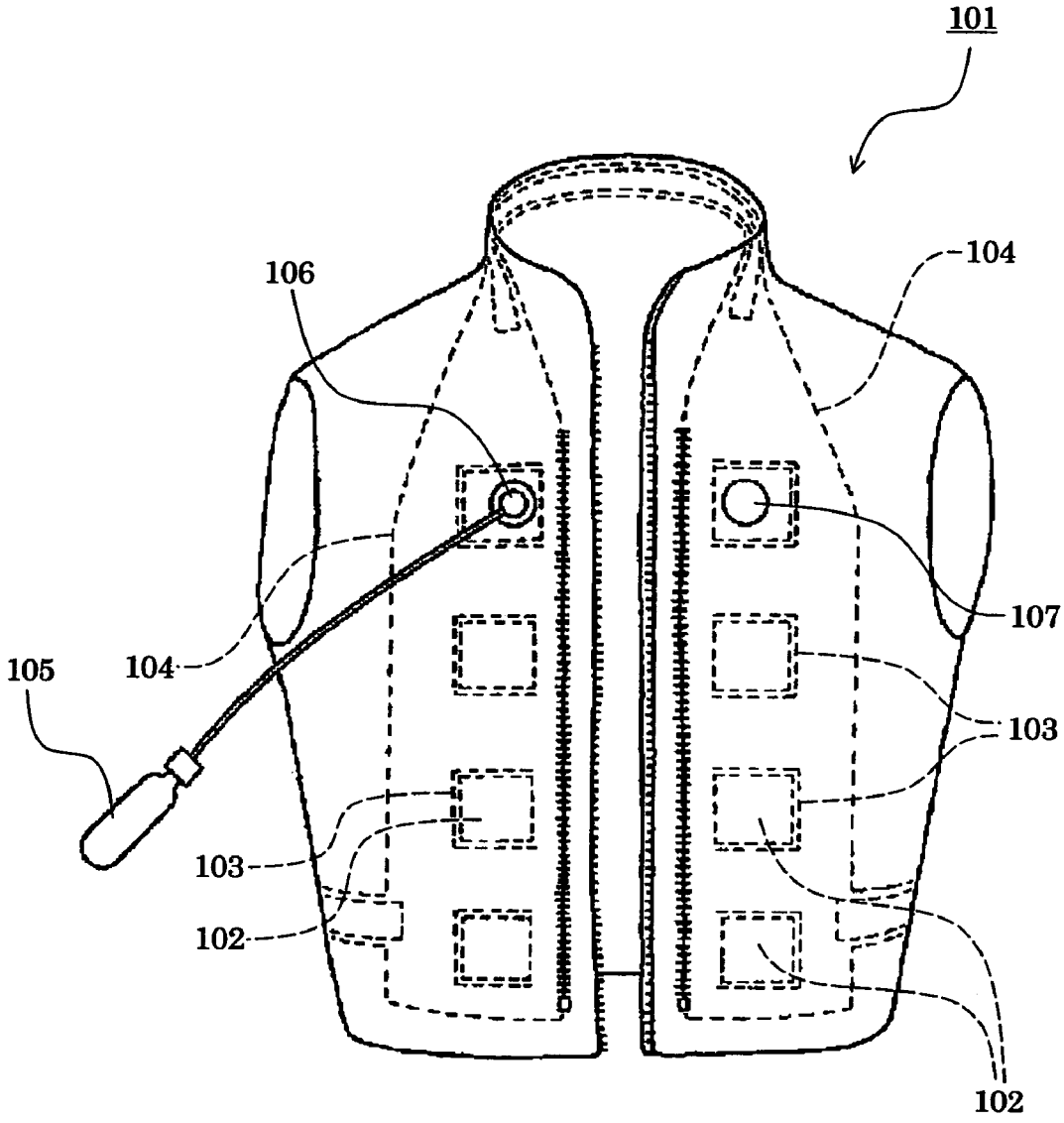
FIG. 1 PRIOR ART
FIG. 1 is a back view showing a life-saving device in the related art.
Figure 2:
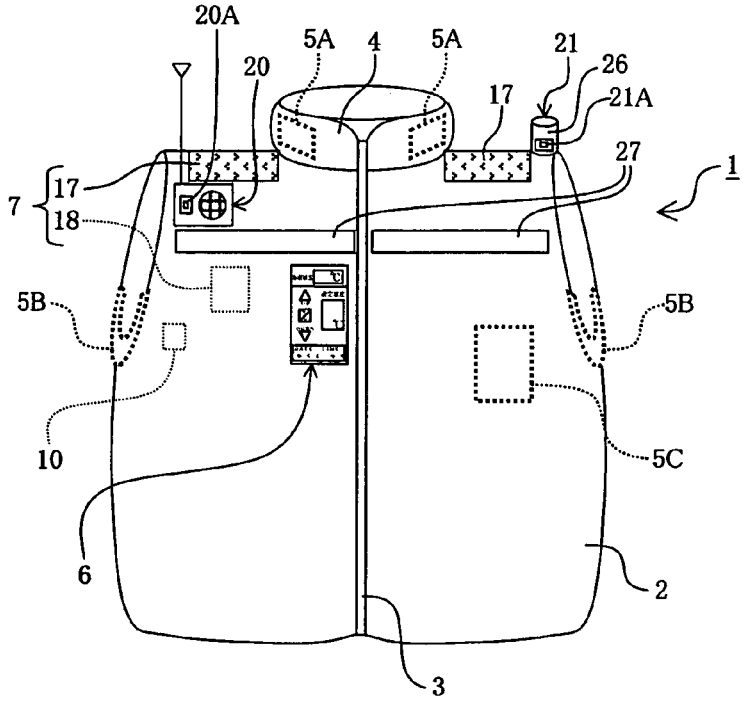
FIG. 2 is a front view of a life-saving device provided with a body temperature adjuster according to a first embodiment of the present invention.
Figure 3:
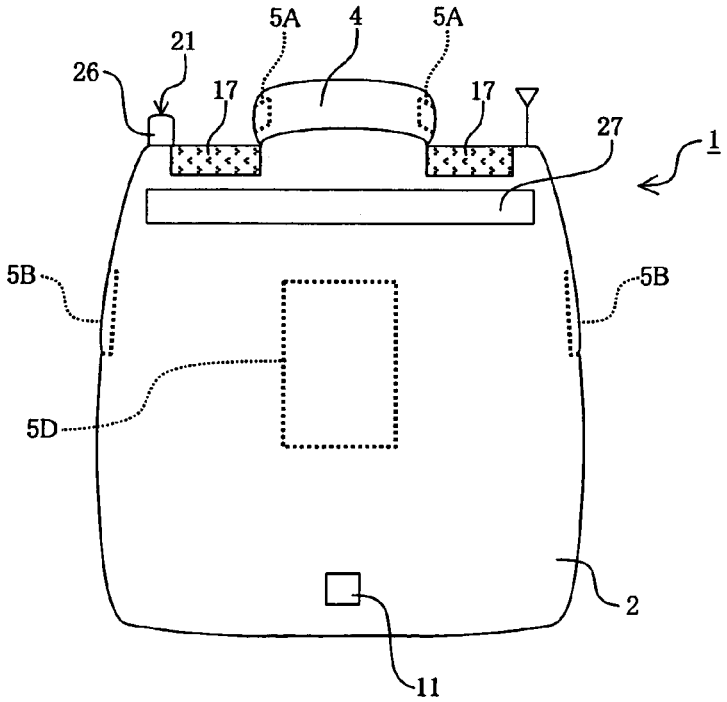
FIG. 3 is a back view of the life-saving device.
Figure 4:
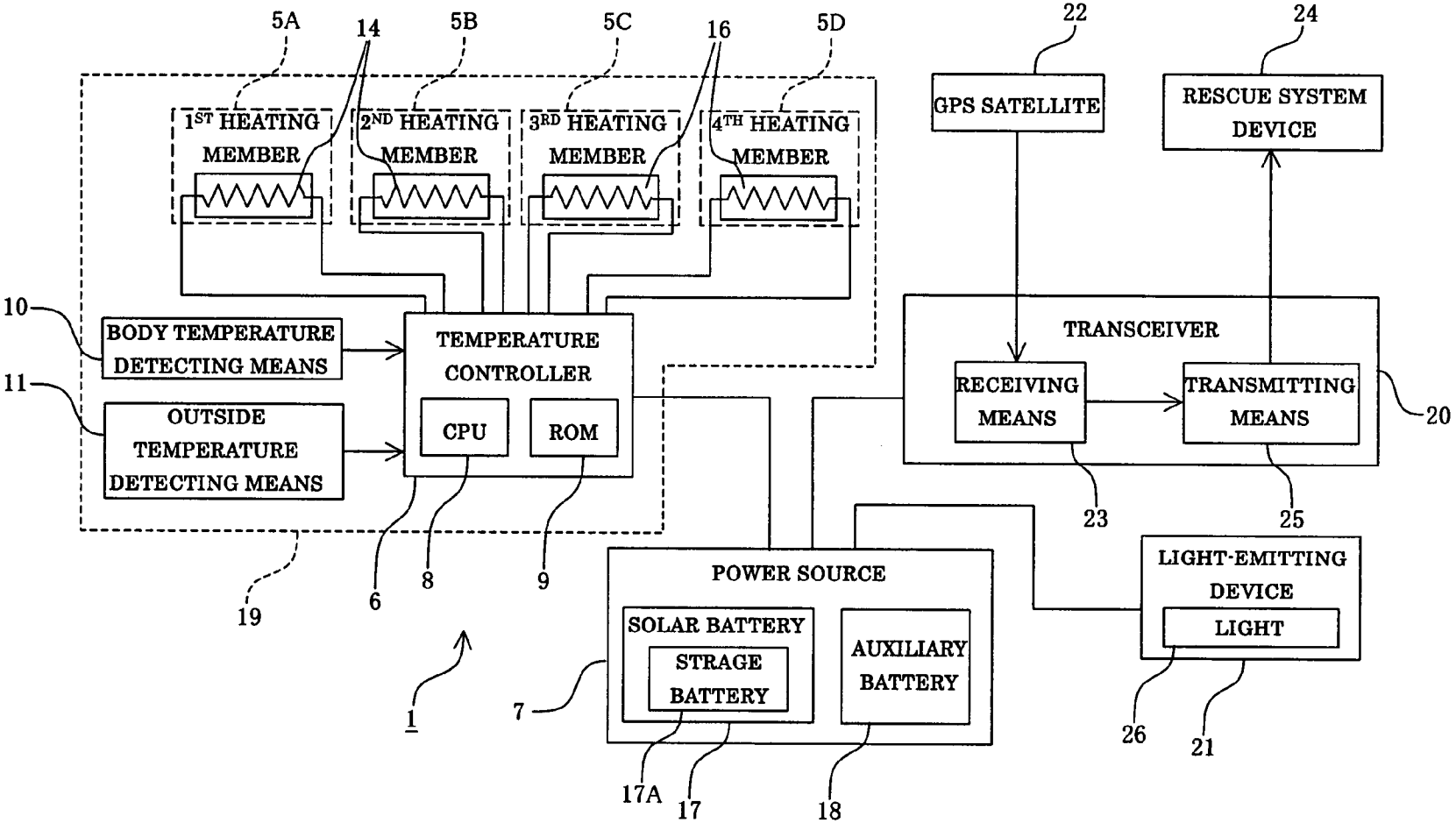
FIG. 4 is a block diagram showing a structure of the life-saving device.
Figure 5:
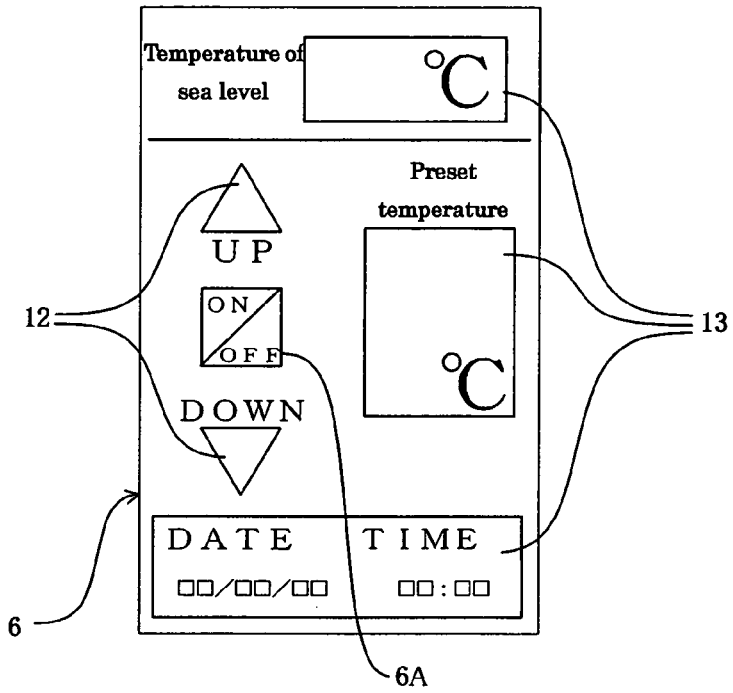
FIG. 5 is a front view showing a temperature controller of the life-saving device.

Referring now to the drawings, an embodiment of the present invention will be described.

First Embodiment

FIG. 2 to FIG. 6 show a life-saving device provided with a body temperature adjuster according to a first embodiment of the present invention. The main body of the life-saving device 1 is a marine-disaster-specific life jacket (life-saving device body) 2 having a buoyant property and a water-proof property and being superior in heat-retaining property, and is opened and closed via a fastener 3 provided at the center of the front face.

The life-saving device 1 includes first heating members 5A, 5A disposed inside a collar 4 so as to contact in the vicinity of both sides of the neck where common carotid arteries run through when the life saving device body 2 is put on the body, second heating members 5B, 5B disposed inside the life-saving device body 2 so as to contact the portion in the vicinity of the both armpits where axillary arteries run through, a third heating member 5C disposed inside the life-saving device body 2 so as to contact the portion in the vicinity of the heart, and a fourth heating member 5D disposed inside the life-saving device body 2 so as to contact the central portion of the back of the body where aorta runs through.

Each heating member 5 is configured in such a manner that a current supplied from a power source 7 is controlled by a temperature controller 6 provided on the outer surface of the life-saving device body 2, so that the temperature thereof is adjusted. The temperature controller 6, including a CPU 8 and a ROM 9, compares the body temperature detected by a body temperature detecting means 10 disposed on the inner surface of the life-saving device body 2 for detecting the body temperature of the wearer with the standard body temperature stored in the ROM 9 in advance, calculates it in the CPU 8 and to control the current supplied from the power source 7 to each heating member 5 so that the body temperature of the wearer is maintained at a proper temperature, and adjusts the temperature of each heating member 5. The temperature controller 6 is configured to set a target temperature as desired using a body temperature setting button 12 for setting the standard body temperature based on the outside temperature detected by an outside temperature detecting means 11 disposed on the outer surface of the life-saving device body 2 for detecting the outside temperature (sea water temperature). The reference numeral 13 is a display unit 13 for displaying the preset body temperature, the temperature of sea water, date, time, and so on.

Figure 6:
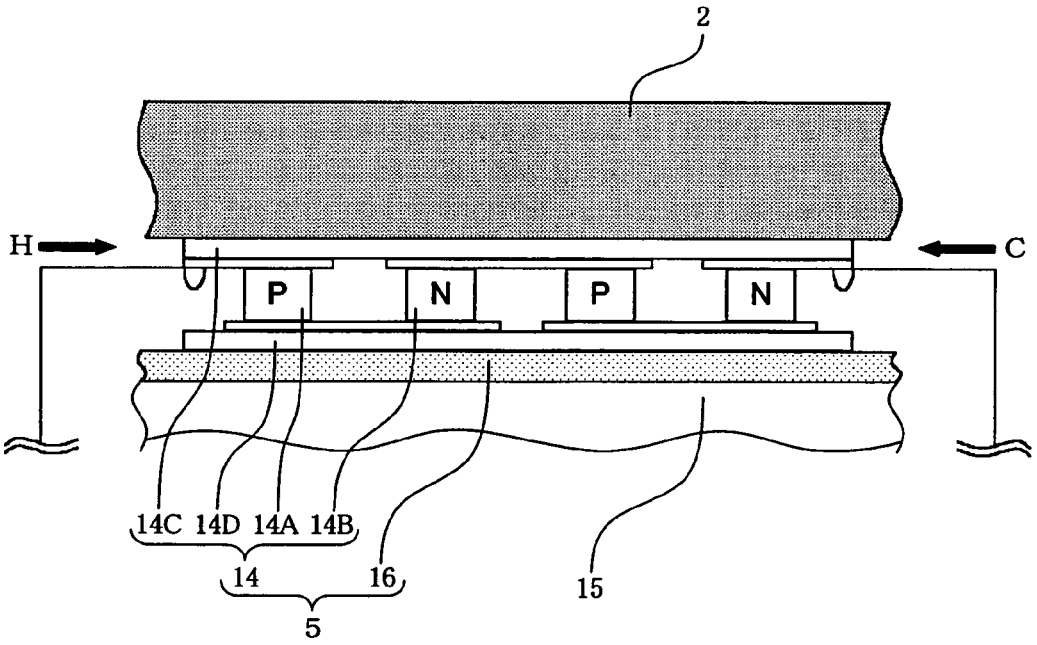
FIG. 6 is a cross-sectional view of a principal portion showing a heating member of the life-saving device.

As sown in FIG. 6, each heating member 5 includes a plurality of pairs of elements including P-type (+) thermoelectric material 14A and n-type (–) thermoelectric material 14B, a Peltier element 14 having planar metal strips 14C, 14D having plate-shaped electrodes on both surfaces, and a heat conductor 16 formed of gel or the like which has high heat conductivity for transmitting heat of the Peltier element 14 to a portion 15 of the body to be heated or cooled. The metal strip 14D side (the side of the portion 15 to be heated or cooled) of the Peltier element 14 generates heat when the current flows in the direction indicated by an arrow H, and cools when the current flows in the direction indicated by an arrow C. Heat from the Peltier element 14 is transmitted to the portion in the vicinity of the both sides of the neck, the portion in the vicinity of the both armpits, the portion in the vicinity of the heart, and the central portion of the back of the body via the heat conductor 16.

The power source 7 for supplying electricity to each heating member 5 includes a solar battery 17, a storage battery 17A for storing an electric power generated by the solar battery 17, and an auxiliary battery 18 used in the case where the electric power from the solar battery 17 and the storage battery 17A is running short. Accordingly, the electric power generated by the solar battery 17 provided on the surface of the life-saving device body 2 can be stored in the storage battery 17A, and hence the electric power supply is ensured even during the night from the storage battery 17 and the auxiliary battery 18.

As described above, the temperature controller 6 controls the current to be supplied to each heating member 5 based on the value detected by the body temperature detecting means 10 so that a body temperature adjuster 19 of the life-saving device 1 can adjust the temperature of the heating members 5 and maintain the body temperature of the wearer at the standard body temperature.

In addition, the life-saving device 1 includes a transceiver 20 for clearly signaling the rescuer the position of the wearer in case of distress, and a light-emitting device 21 disposed at a level higher than the sea level so that the wearer can easily be found by the rescuer around the site of distress.

The transceiver 20 includes a receiving means 23 for receiving current position information from a GPS satellite 22 and a transmitting means 25 for transmitting the received current position information to a rescue system device 24. The rescue system device 24 selects a rescue boat or a rescue aircraft being at the nearest place automatically based on the received current position information of the wearer, and gives information on direction and distance and rescue instruction to the site of distress to the selected rescue boat or rescue aircraft. Then the rescuers, who received the rescue instruction, are navigated by the direction and distance information to the victim quickly.

It is also possible to provide a communication means in the transceiver 20 for communicating with other transceivers and use the transceiver as a main device and other transceivers as sub devices. In this case, other transceivers (sub devices) need only the communication means for communicating with the transceiver (main device) and transmitting the current positions of their own to the main device. Therefore, it can be manufactured at a lower cost than that of the main device. Accordingly, when a ship is shipwrecked, by providing the main device on the life-saving device which the captain of the ship wears and the sub-devices on the life-saving devices which other crews other than the captain wear, the cost reduction is achieved.

The light-emitting device 21 includes a light 26 turning on or flickering by being supplied with a power from the power source 7 so as to clearly signal the rescuers around the site of distress the position of the wearer.

The life-saving device body 2 is colored in a fluorescent color on the outside surface and is provided with a reflective strip 27 on the upper part of the front and back surface so as to signal the rescuers the position of the wearer even in the case of distress at night.

Subsequently, the operation of the life-saving device 1 will be described.

The victim of the distress wearing the life-saving device body 2 turns on a switch 6A provided on the surface of the temperature controller 6 to activate the body temperature adjuster 19. The temperature controller 6 compares the body temperature detected by the body temperature detecting means 10 with the standard body temperature stored in the ROM 9 in advance, calculates it by the CPU 8, and fine-adjusts the temperature of each heating member 5 so that the body temperature of the wearer is maintained at a proper body temperature. In this case, the wearer can adjust the preset temperature as desired by the setting button 12 based on the outside temperature detected by the outside temperature detecting means 11. The temperature controller 6 fine-adjusts the temperature of each heating member 5 by controlling the current that the power source 7 supplies to each heating member 5, and heats or cools the both sides of the neck, the both armpits, the central portion of the back of the body, and the portion in the vicinity of the heart of the wearer. Accordingly, the life-saving device 1 can effectively fine-adjust the body temperature of the wearer and maintains the body temperature of the wearer at a proper body temperature.

The wearer also turns on a switch 20A provided on the surface of the transceiver 20, and activates the transceiver 20 by utilizing the electric power supplied from the power source 7. The transceiver 20 receives the current position information from the GPS satellite 22 by the receiving means 23. The received current position information is transmitted by the transmitting means 25 to the rescue system device 24. The rescue system device 24 selects a rescue boat or a rescue aircraft being at the nearest position automatically based on the current position information of the wearer, gives information on a direction and a distance to the site of distress, and rescue instruction to the selected rescue boat or rescue aircraft, so that the rescuers, who received the rescue instruction, goes for rescue the wearer.

The wearer further turns on a switch 21A provided on the surface of the light-emitting device 21 to activate the light-emitting device 21 using the electric power supplied from the power source 7. The activated light-emitting device 21 turns on or flickers the light 26 to signal the rescuer being present around the site of distress the position of the wearer.

As described thus far, in the present embodiment, the life-saving device 1 includes the first heating members 5A, 5A disposed at the positions coming contact with the both sides of the neck where common carotid arteries run through when the life-saving device body 2 is putted on the body, the second heating members 5B, 5B disposed at the position coming contact with the both armpits where axillary arteries run through, the third heating member 5C disposed at the position coming contact with the portion in the vicinity of the heart, and the fourth heating member 5D disposed so as to contact the central portion of the back of the body where aorta runs through, the power source 7 for supplying electricity to each heating member 5, the body temperature detecting means 10 for detecting the body temperature, the outside temperature detecting means 11 for detecting the outside temperature, and the temperature controller 6 for adjusting the temperature of each heating member 5 in response to the temperature detected by the body temperature detecting means 10 and the outside temperature detecting means 11, so that the body temperature is maintained at a proper body temperature in case of emergency. Accordingly, the portions where circulating blood flow having significant body temperature adjusting capability passes through can be cooled or heated. As a consequence, even in case of distress in the sea area of low temperature or in the area of high sea water temperature, if the present life-saving device 1 is worn, the body temperature can effectively be fine-adjusted, and hence the body temperature of the wearer can be maintained at a proper body temperature.

The life-saving device 1 includes the receiving means 23 for receiving the current position information from the GPS satellite 22, and the transceiver 20 having the transmitting means 25 for transmitting the received current position information to the rescue system device 24, whereby it can let the rescuers acknowledge the current position of the wearer quickly and accurately.

In addition, there is provided the light-emitting device 21 for turning on or flickering the light 26 using the electric power supplied from the power source 7, the life-saving device body 2 is colored into a fluorescent color on the surface thereof, and reflective strips 27 are provided on the upper part of the front and the back surface of the life-saving device body 2. Accordingly, the wearer can let the rescuers being around the site of distress acknowledge the wearer's current position clearly.

In brief, according to the life-saving device 1 of the present embodiment, the wearer can let the rescuers acknowledge the position of distress by the transceiver 20, the light-emitting device 21, and the reflective strips 27 quickly and clearly, and can maintain his/her body temperature at a proper body temperature by the body temperature adjuster 19 for fine-adjusting the body temperature of the wearer until he/she is rescued. Accordingly, the percentage of survival of the victim of the marine disaster can be increased in comparison with the life-saving device in the related art.

In the embodiment described above, the life-saving device body 2 is a marine-disaster-specific life jacket 2 having a floating performance. However, the life-saving device 1 according to the present invention can be applied to a cloth to be worn in the area here the outside temperature is excessively higher or lower than the standard body temperature, for example, a bullet-proof vest having a bullet-proof property to be worn in the desert region where the difference of the temperature is significant between the day and the night, the fire-resistant cloth having a fire-resistant property to be worn in the fire site, and the heavy winter cloths having a cold-resistant property to be worn in the mountain in winter or in cold districts.

Second Embodiment

Figure 7:
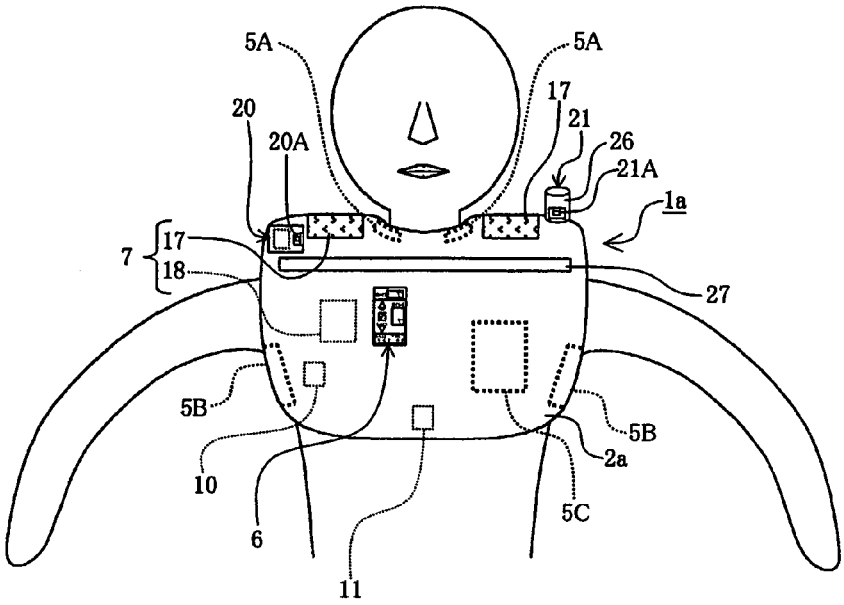
FIG. 7 is an explanatory drawing of a life-saving device provided with a temperature adjuster according to a second embodiment of the present invention.
Figure 8:
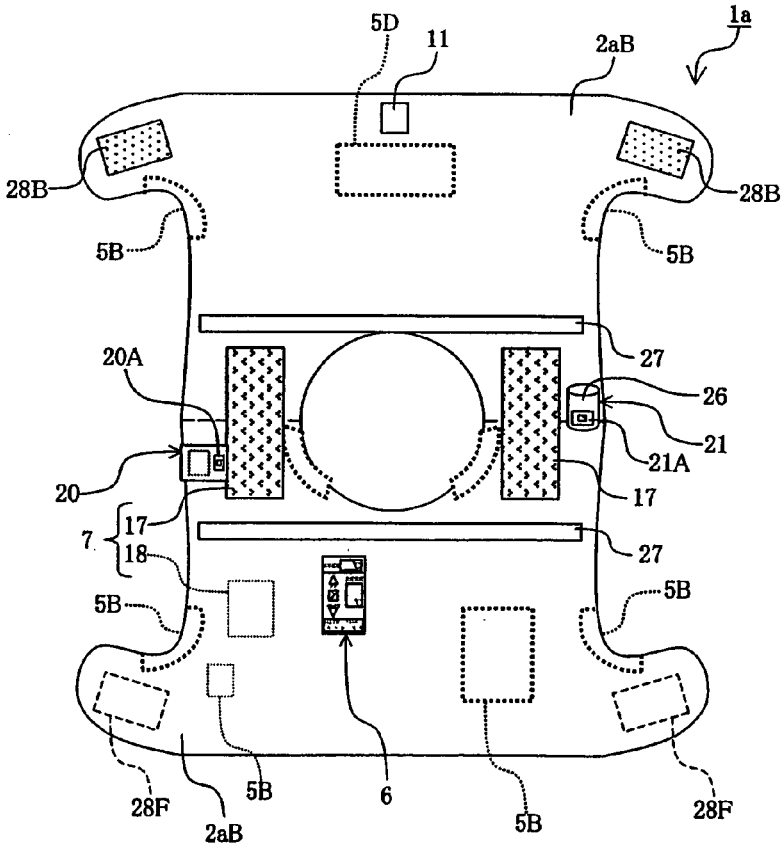
FIG. 8 is a top view showing a extended state of the life-saving device of the second embodiment.

FIG. 7 and FIG. 8 show a life-saving device provided with a body temperature adjuster according to the second embodiment. The components identical to the first embodiment are represented by the identical reference numerals, and the description will be omitted.

In the present embodiment, the main body of the life-saving device 1*a* is a marine-disaster-specific neck-hanging style life vest (life-saving device body) 2*a* having a floating property and a water-proof property, and being superior in temperature-retaining property. The life-saving device body 2*a* is designed to wear by putting on around the neck, joining the left and the light ends of the front surface 2*a*F and the back surface 2*a*B by hook-and-loop fasteners 28F, 28B disposed so as to be fastened when overlapped one on another.

In this case as well, the same effects as the first embodiment can be obtained, and the life-saving device body 2*a* is easy to wear, and can be stored compactly. Therefore, it is usable as a life-saving device for passengers or crews of an aircraft, where the storage space is limited.

Third Embodiment

Figure 9:
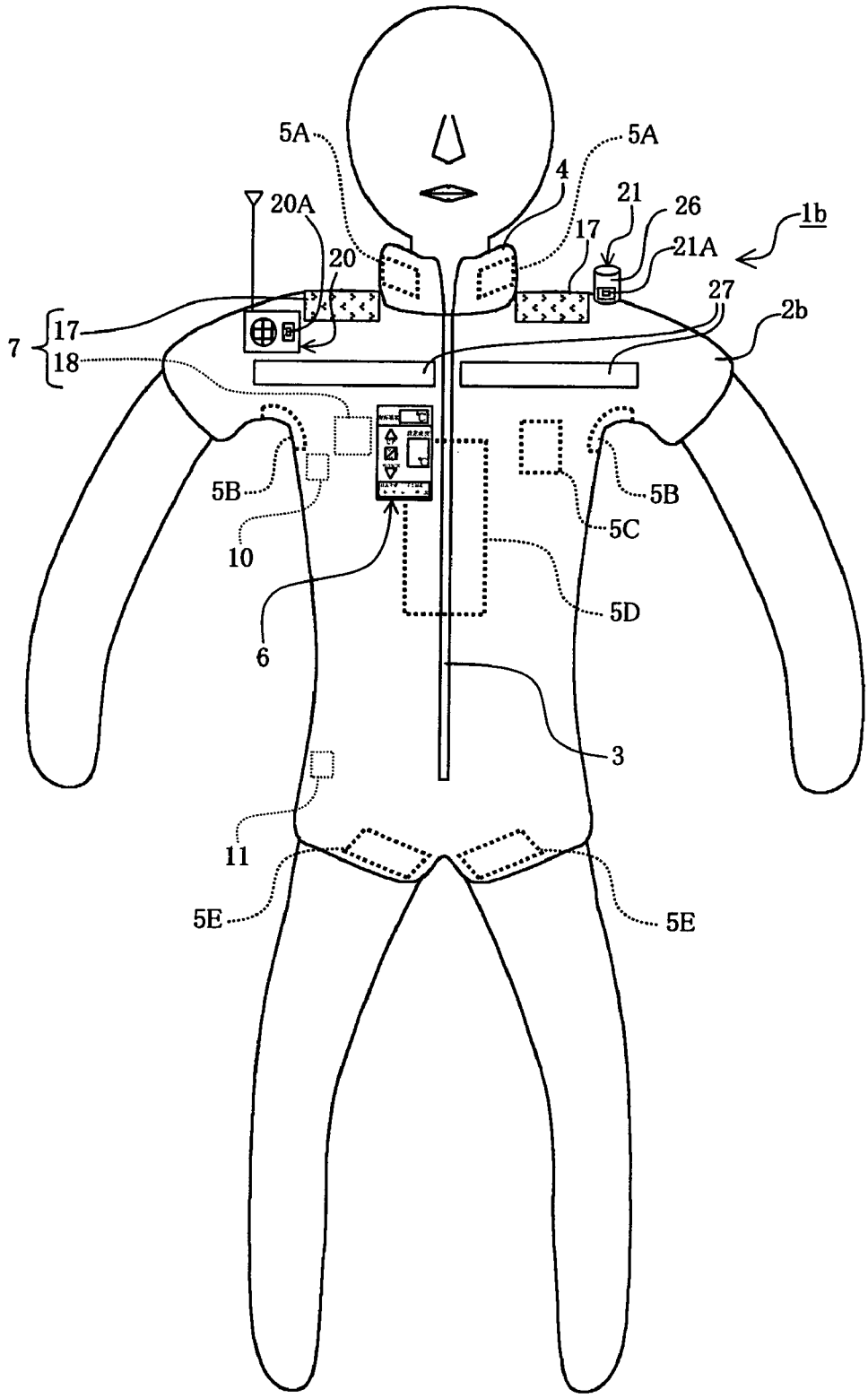
FIG. 9 is a front view showing a state in which a life-saving device provided with a body temperature adjuster according to a third embodiment of the present invention is worn.

FIG. 9 shows a life-saving device provided with a body temperature adjuster according to the third embodiment of the present invention. The components identical to the first embodiment are represented by the identical reference numerals, and the description will be omitted.

In the present embodiment, the main body of the life-saving device 1*b* is a marine-disaster-specific all-in-one life-saving suit (life-saving device body) 2*b* having a buoyant property and a water-proof property, and being superior in temperature-retaining property, and is designed to open and close by the fastener 3 extending from the collar 4 at the front center to the belly.

The life-saving device 1*b* includes fifth heating members 5E, 5E disposed inside so as to contact the groins where external iliac arteries run through when the life-saving device 2*b* is put on the body, in addition to the first heating members 5A, 5A disposed inside the collar 4 so as to contact in the vicinity of both sides of the neck where common carotid arteries run through, the second heating members 5B, 5B disposed inside the life-saving device body 2*b* so as to contact the portion in the vicinity of the both armpits where axillary arteries run through, the third heating member 5C disposed inside the life-saving device body 2*b* so as to contact the portion in the vicinity of the heart, and the fourth heating member 5D disposed inside the life-saving device body 2*b* so as to contact the central portion of the back of the body where aorta runs through.

The temperature controller 6 provided on the outer surface of the life-saving device body 2*b* controls a current supplied from the power source 7 and adjusts the temperature of the fifth heating members 5E as in the case of the first heating members 5A, the second heating members 5B, the third heating member 5C, and the fourth heating member 5D.

In this case as well, the same effects as the first embodiment can be obtained and, in addition, by the provision of the fifth heating members 5E, 5E disposed so as to contact the both groins when the life-saving device body 2*b* is put on the body, the portion where external iliac arteries, which has a significant body temperature adjusting capability for the legs, runs through can be heated or cooled. Accordingly, the body temperature of the wearer can be fine-adjusted more effectively.

In addition, since the main body of the life-saving device 1*b* is the marine-disaster-specific all-in-one life-saving suit 2*b* which covers from the upper half of the body to the lower half of the body, it has higher buoyant property and temperature retaining property than the life-saving device body 2 according to the first embodiment, and hence improvement of the percentage of survival of the victim of the marine disaster is achieved.

Fourth Embodiment

Figure 10:
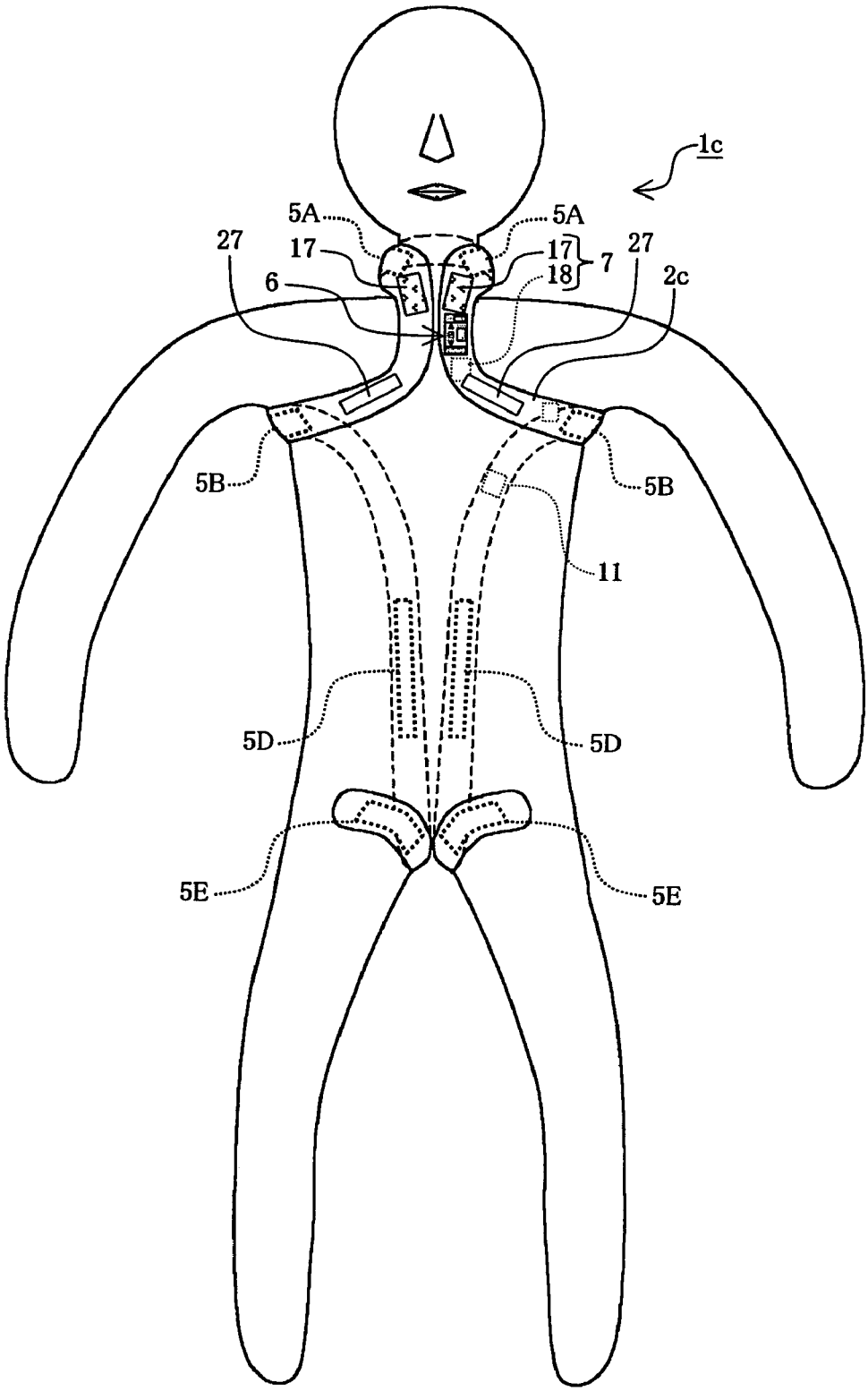
FIG. 10 is a front view showing a state in which a life-saving device provided with a body temperature adjuster according to a fourth embodiment of the present invention is worn.

FIG. 10 shows a life-saving device provided with a body temperature adjuster according to the fourth embodiment of the present invention. The components identical to the first embodiment are represented by the identical reference numerals, and the description will be omitted.

In the present embodiment, the main body of the life-saving device 1*c* is a marine-disaster-specific tubular life-saving device (life-saving device body) 2*c* having a buoyant property and a water-proof property. The life-saving device body 2*c* is formed of a single rubber tube or the like being superior in water-proof property and durability.

The life-saving device 1*c* includes the first heating members 5A, 5A disposed inside the life-saving device body 2*c* so as to contact in the vicinity of both sides of the neck where common carotid arteries run through when the life-saving device body 2*b* is worn, the second heating members 5B, 5B disposed inside the life-saving device body 2*c* so as to contact the portion in the vicinity of the both armpits where axillary arteries run through, the fourth heating members 5D, 5D disposed inside the life-saving device body 2*c* so as to contact the central portion of the back of the body where aorta runs through, and the fifth heating members 5E, 5E disposed inside the life-saving device body 2*c* so as to contact the groins where external iliac arteries run through.

How to wear the life-saving device 1*c* will be described below.

In a first place, the wearer aligns the center of the life-saving device body 2*c* with the center of the back of the neck, and in this state, brings both ends of the life-saving device body 2*c* to the front side of the body so as to pass along both sides of the neck, while adjusting the position of the first heating members 5A, 5A so as to contact common carotid arteries running through both sides of the neck.

From this state, the wearer brings the both ends to the back side through under the left and the right arms, and adjusts the position of the second heating members 5B, 5B so as to contact the both armpits. Then, the wearer adjusts the positions of the fourth heating members 5D, 5D so as to contact the center portion of the back of the body, and then brings the both ends of the life-saving device body 2 to the front through between the legs, where the fifth heating members 5E, 5E are adjusted so as to contact the both groins.

As described above, according to the present embodiment, the marine-disaster-specific tubular life-saving device 2*c* having a buoyant property and a water-proof property is employed as the main body of the life-saving device 1*c*, and the same effects as in the first embodiment can be obtained.

Since the life-saving device 1*c* is formed of a single rubber tube superior in water-proof property and durability, it can be stored compactly by discharging air and folding. Consequently, it is effective as the life-saving device for passengers or crews of an aircraft in which the storage space is limited and, in addition, it can be brought easily for marine leisure or the like.

While the present invention has been described in detail, it is to be understood that the present invention is not limited thereto, and various changes may be made without departing from the scope of the invention.

What is claimed is:

1. A life-saving device provided with a body temperature adjuster comprising:

heating members disposed so as to contact both sides of the neck where the common carotid arteries run through and the both armpits where axillary artery run through when the life-saving device body is put on the body;

a power source for supplying electricity to the heating members;

a body temperature detecting means for detecting the body temperature;

an outside temperature detecting means for detecting the outside temperature; and a temperature controller for adjusting the temperature of the heating members in response to the temperatures detected by the body temperature detecting means and the outside temperature detecting means, wherein the body temperature is maintained at a proper temperature in case of emergency.

2. A life-saving device provided with a body temperature adjuster according to claim 1, wherein the heating member is disposed so as to pass in the vicinity of the heart when the wearer wears the life-saving device body.

3. A life-saving device provided with a body temperature adjuster according to claim 1, wherein the heating member is disposed so as to contact the central portion of the back of the body where the aorta runs through when the wearer wears the life-saving device body.

4. A life-saving device provided with a body temperature adjuster according to claim 2, wherein the heating member is disposed so as to contact the central portion of the back of the body where the aorta runs through when the wearer wears the life-saving device body.

5. A life-saving device provided with a body temperature adjuster according to claim 1, wherein the heating members are disposed so as to contact groins where external iliac arteries run through when the wearer wears the life-saving device body.

6. A life-saving device provided with a body temperature adjuster according to claim 2, wherein the heating members are disposed so as to contact groins where external iliac arteries run through when the wearer wears the life-saving device body.

7. A life-saving device provided with a body temperature adjuster according to claim 3, wherein the heating members are disposed so as to contact groins where external iliac arteries run through when the wearer wears the life-saving device body.

8. A life-saving device provided with a body temperature adjuster according to any one of claim 1, wherein the life-saving device body is a marine-disaster-specific life jacket having a buoyant property and a water-proof property.

9. A life-saving device provided with a body temperature adjuster according to claim 1, wherein the life-saving device body is a marine-disaster-specific neck-hanging style life vest having a buoyant property and a water-proof property.

10. A life-saving device provided with a body temperature adjuster according to claim 1, wherein the life-saving device body is a marine-disaster-specific tubular life-saving device having a buoyant property and a water-proof property.

11. A life-saving device provided with a body temperature adjuster according to claim 1, wherein the life-saving device body is a marine-disaster-specific all-in-one life-saving suit having a buoyant property and a water-proof property.

12. A life-saving device provided with a body temperature adjuster according to claim 1, wherein the life-saving device body is a bullet-proof vest having a bullet-proof property.

13. A life-saving device provided with a body temperature adjuster according to claim 1, wherein the life-saving device body is a fire-resistant cloth having a fire-resistant property.

14. A life-saving device provided with a body temperature adjuster according to claim 1, wherein the life-saving device body is a heavy winter cloth having a cold-resistant property.

15. A life-saving device provided with a body temperature adjuster according to claim 1, wherein the temperature controller includes ROM in which the standard body temperature is stored, and CPU for comparing the standard body temperature and the body temperature detected by the body temperature detecting means and adjusting the temperature of the heating member.

16. A life-saving device provided with a body temperature adjuster according to claim 15, wherein the temperature controller includes a body temperature setting button for setting the standard body temperature as desired, and a display unit for displaying the standard body temperature.

17. A life-saving device provided with a body temperature adjuster according to claim 1, wherein the heating member comprises one or more Peltier elements of which an electric current supplied from the power source is controlled by the temperature controller, and a heat conductor for conducting heat from the Peltier elements to the body.

18. A life-saving device provided with a body temperature adjuster according to claim 1, wherein the life-saving device body comprises a transceiver having a receiving means for receiving current position information from a GPS satellite and a transmitting means for transmitting the current position information received by the receiving means to a rescue system device.

19. A life-saving device provided with a body temperature adjuster according to claim 18, wherein the transceiver comprises a communication unit for communicating with another transceiver, and the transceiver and another transceiver have a main-sub relationship.

20. A life-saving device provided with a body temperature adjuster according to claim 1, wherein the power source comprises a solar battery and a storage battery storing an electric power generated by the solar battery.

21. A life-saving device provided with a body temperature adjuster according to claim 20, wherein the power source comprises an auxiliary battery.

22. A life-saving device provided with a body temperature adjuster according to claim 1, wherein a part or the entire surface of the life-saving device body is colored into a fluorescent color.

23. A life-saving device provided with a body temperature adjuster according to claim 1, wherein the life-saving device body comprises a light-emitting device on the surface thereof, and the light-emitting device is designed to turn a light on or to blink using the electric power supplied from the power source.

* * * * *